United States Patent [19]

del Castillo

[11] 3,942,404

[45] Mar. 9, 1976

[54] OPTICAL METRONOME WITH TRANSPARENT SHEET MUSIC

[76] Inventor: Juan M. del Castillo, Risco No. 119, Mexico City, Mexico

[22] Filed: Nov. 15, 1974

[21] Appl. No.: 524,332

[52] U.S. Cl. ..... 84/484

[51] Int. Cl.[2] ..... G10G 1/00; G04F 5/02

[58] Field of Search ..... 84/484

[56] References Cited

UNITED STATES PATENTS

| | | | |
|---|---|---|---|
| 825,902 | 7/1906 | Gomme | 84/484 |
| 1,571,110 | 1/1926 | Ebert et al. | 84/484 |
| 1,664,010 | 3/1928 | Welch | 84/484 |
| 1,837,944 | 12/1931 | Blum | 84/484 |
| 2,483,570 | 10/1949 | Bergey | 84/484 |
| 2,915,121 | 12/1959 | Bloom | 84/484 |
| 3,803,971 | 4/1974 | Del Castillo | 84/484 |

*Primary Examiner*—Lawrence R. Franklin
*Attorney, Agent, or Firm*—Karl W. Flocks

[57] ABSTRACT

An optical metronome having a belt moved at a speed set for the music with vertical lines on the belt passing behind a transparent sheet with musical notations thereon in timed relationship according to the speed at which the notes are to be played.

5 Claims, 4 Drawing Figures

OPTICAL METRONOME WITH TRANSPARENT SHEET MUSIC

BACKGROUND OF THE INVENTION

The present invention relates to a device for aiding the teaching of timing or duration in the study of music.

It is an object of the present invention to provide a teaching device which will impart timing and rhythm to the student in the study of music by indicating the timing when each note is to played.

It is also an object of the present invention to allow the student to view the whole music sheet without impediment to the view of any of the notes thereon, with the same view that he will have after he no longer has need for the present device.

It is a further object of the present invention to allow the teaching device to be a very simple and comparatively inexpensive device.

SUMMARY OF THE INVENTION

The present invention relates to an optical form of metronome having a casing within which are mounted a pair of rollers, one a driving roller and the other an idler roller, having a continuous web passing therebetween, with at least two vertical lines on said web and transverse thereto, and a transparent sheet with musical notation thereon supported in front of said web.

BRIEF DESCRIPTION OF THE DRAWING

Other objects and advantages will be apparent from the following description, reference being had to the accompanying drawing wherein.

DESCRIPTION OF THE PREFERRED EMBODIMENTS

Figure 1:
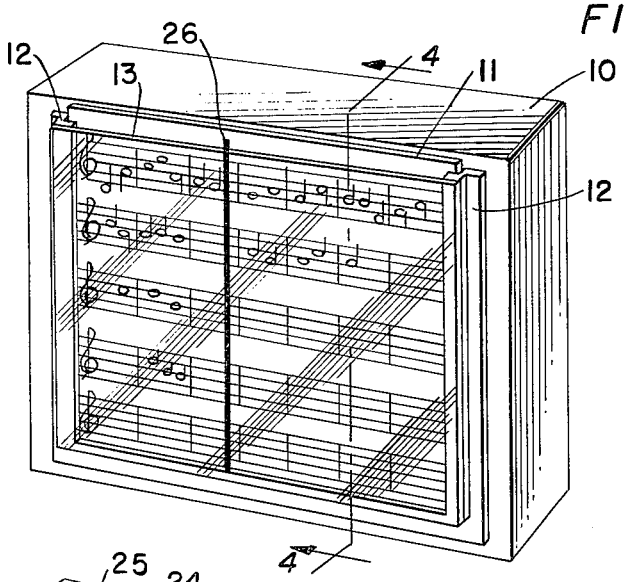
FIG. 1 is the optical metronome of the present invention in a casing.

Referring first to FIG. 1, there is shown the device of the present invention encased in case 10 with a transparent sheet 11 having musical notation thereon insertable in music sheet holder frame 12 mounted on the front of case 10. A glass cover plate 13 attached on frame 12 and cover plate 13′ mounted as a window over a front opening in case 10 aid in maintaining transparent music sheet 11 in its position in front of case 10. Plates 13 and 13′ could also be transparent plastic instead of glass as mentioned above.

Figure 2:
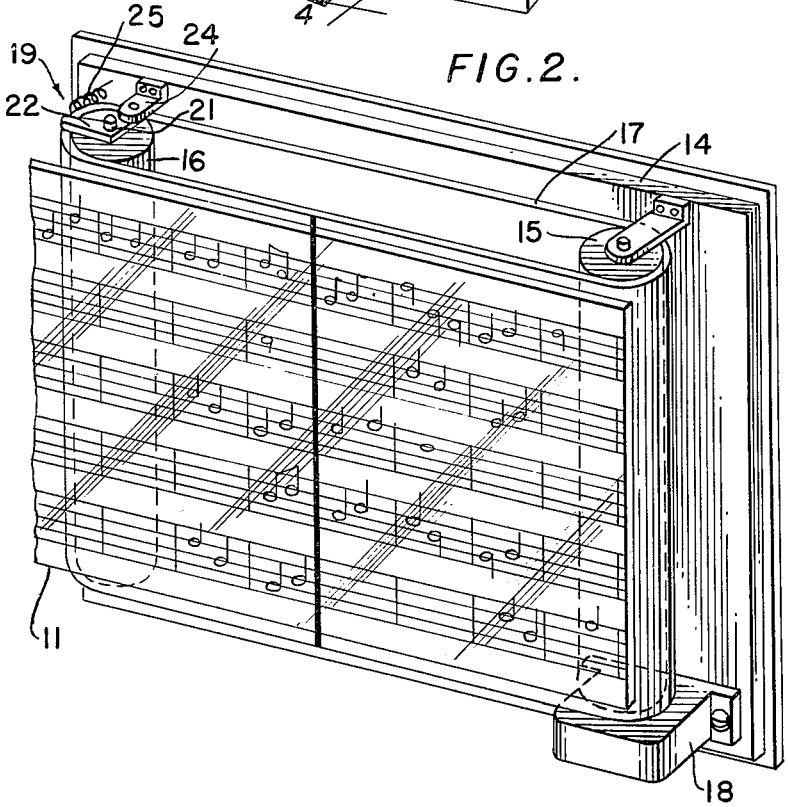
FIG. 2 is an enlarged view of the device of FIG. 1 with the case removed.
Figure 4:
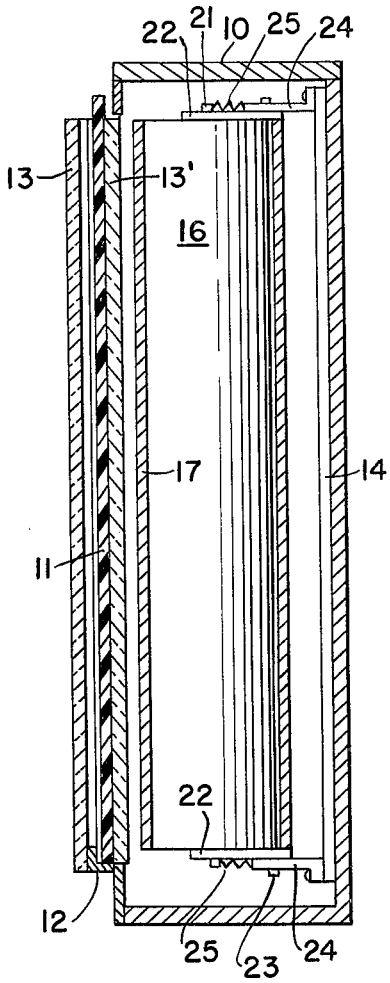
FIG. 4 is an enlarged cross-sectional view of FIG. 1 along lines 4—4.
Figure 3:
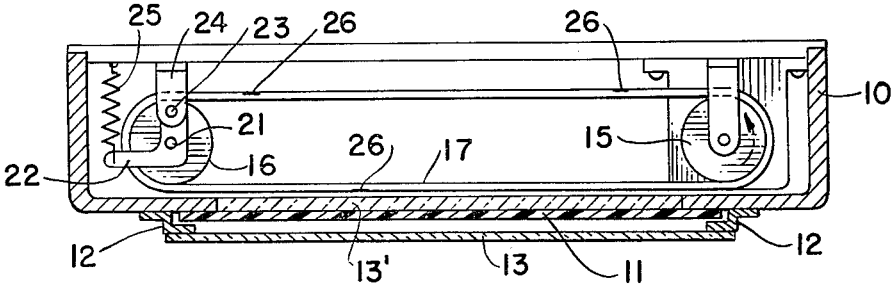
FIG. 3 is an enlarged top plan view of the device of FIG. 1 with only the top of the case removed.

An enlarged view with case 10 removed is shown in FIG. 2. Enlarged cutaway views of the device are shown in FIGS. 3 and 4. On a supporting backboard 14 there are mounted rollers 15 and 16 which are mounted by means of brackets to backboard support 14. A continuous web or belt 17 which may be either opaque or transparent and which has a width approximately that of the music sheet 11 passes over rollers 15 and 16 and is moved by them. If a transparent web is used, a backing would be necessary between front and back portions of web 17 to prevent the distraction of the return portion of the web being seen moving behind the moving front portion of the web. Driving roller 15 is driven by a motor contained in box 18 and connected to roller 15 by appropriate gearing. The motor in box 18 has controls (not shown) which may be used to operate it at different speeds in accordance with the timing required for the particular sheet of music. Such control with the motor could be a rheostat or alternatively a multiple geared and clutching arrangement.

In order to maintain web 17 under tension, a tension maintaining device 19 is shown in FIGS. 2, 3 and 4. Idler roller 16 turns on its axle 21 held in brackets 22 which in turn pivot at points 23 on brackets 24 which in turn are attached to backboard support 14. Springs 25 attached to bracket 22 at the opposite end from their connection at pivot point 23 maintain the proper tension on web 17.

A vertical line 26 on web 17 as shown in FIGS. 1 and 2 moves across and behind transparent music sheet 11 in timed relation to the music being played, with the timing determined by the motor in box 18 and its attachment to roller 15. Other vertical lines 26 also drawn transversely of web 17 are at the same time passing between the rollers 15 and 16 on their side closest to backboard support 14 and are placed on web 17 so as to be positioned at the beginning of the lines of music just as the preceding vertical line has reached the end of a line of music. Depending upon the size of the device and of web 17 there may be more or less than 3 vertical lines 26 but not less than 2 of these vertical lines. Although not shown as part of the invention, the casing may be so arranged as shown in FIG. 1 so that the music sheet 11 protrudes above glass cover plate 13 so that it may be easily removed when finished.

It will be obvious to those skilled in the art that various changes may be made without departing from the scope of the invention and the invention is not to be considered limited to what is shown in the drawings and described in the specification.

What is claimed is:

1. An optical type of metronome comprising
   - a transparent music sheet with musical composition thereon,
   - a pair of rollers mounted in spaced relation to each other,
   - a continuous web passing around and between said rollers and positiond behind said transparent sheet,
   - at least two vertical lines drawn on said web transversely of said web,
   - means to drive said rollers to move said vertical lines past and behind said transparent sheet in timed relation to the musical composition on said transparent sheet,
   - supporting means for said transparent sheet including transparent rigid support sheets positioned in front of and behind said transparent music sheet.

2. The type of metronome of claim 1, further characterized by
   - said web being of opaque material.

3. The type of metronome of claim 1, further characterized by
   - said web having at least three vertical lines spaced from each other and drawn transversely of said web.

4. The metronome of claim 1 further characterized by
   - said transparent music sheet being of flexible sheet material adapted for folding or rolling of said sheet.

5. The type of metronome of claim 1, further characterized by tension means connected to the other of said rollers than the one connected to said driving means, said tension means including pivotal means supporting said other of said rollers, and spring means connected to the other end of said pivotal means from the end at which it pivots whereby said web is maintained under proper tension for operation.

* * * * *